United States Patent [19]

Harreither

[11] Patent Number: 5,021,102

[45] Date of Patent: Jun. 4, 1991

[54] METHOD OF MAKING A BAND FOR A BAND PRESS

[75] Inventor: Rupert Harreither, Baden, Austria

[73] Assignee: Austria Metall Aktiengesellschaft, Braunau am Inn, Austria

[21] Appl. No.: 477,360

[22] Filed: Feb. 7, 1990

[30] Foreign Application Priority Data

Feb. 7, 1989 [AT] Austria ..... 249/89

[51] Int. Cl.[5] ..... C21D 1/48; B32B 15/18

[52] U.S. Cl. ..... 148/13; 148/12 D; 148/15; 148/142; 148/143; 427/433; 428/666

[58] Field of Search ..... 148/12 D, 13, 15, 142, 148/143; 428/666; 427/433

[56] References Cited

U.S. PATENT DOCUMENTS

| | | | |
|---|---|---|---|
| 4,007,351 | 2/1977 | Annerhed et al. | 148/142 |
| 4,021,272 | 5/1977 | Asai et al. | 148/15 |
| 4,252,866 | 2/1981 | Matsudo et al. | 148/12 D |
| 4,361,448 | 11/1982 | Sippola | 148/143 |

FOREIGN PATENT DOCUMENTS

| | | | |
|---|---|---|---|
| 1044553 | 1/1948 | Fed. Rep. of Germany . | |
| 2019494 | 2/1971 | Fed. Rep. of Germany . | |
| 0163219 | 12/1981 | Japan | 148/12 D |
| 3047357 | 2/1988 | Japan | 148/12 D |
| 3047358 | 2/1988 | Japan | 148/12 D |
| 211118 | 11/1940 | Switzerland . | |
| 226028 | 6/1943 | Switzerland . | |
| 797423 | 7/1958 | United Kingdom . | |
| 934559 | 8/1963 | United Kingdom . | |
| 2203450 | 10/1968 | United Kingdom . | |

*Primary Examiner*—Upendra Roy
*Attorney, Agent, or Firm*—Herbert Dubno

[57] ABSTRACT

A method of making a steel band for a double-band press or the like starts with a rolled strip having a tensile strength less than 1250 N/mm$^2$ of a precipitation-hardenable steel which is subjected to galvanic coating with hard chromium along at least one surface. The band is then subjected to a precipitation hardening heat treatment and as a result of that heat treatment has a tensile strength in excess of 1400 N/mm$^2$.

3 Claims, 1 Drawing Sheet

METHOD OF MAKING A BAND FOR A BAND PRESS

FIELD OF THE INVENTION

My present invention relates to a method of making a band for a band press and to a method of treating a hot rolled or cold rolled steel band for use in such a press.

BACKGROUND OF THE INVENTION

For the production of technological and decorative laminates, layered pressed goods, coated or bonded pressed plates or slabs, fiberboard, pressed board and laminates of all kinds, it is common practice to employ multilevel presses, single-level presses, double-band presses and other band-type machines. For the machines of the latter type, i.e. the double-band presses in which the article to be pressed is received between a pair of endless belts, generally of steel and referred to as steel bands herein, and other machines in which the article to be pressed is received on a steel band, the fabrication of the steel band or a band from another metal alloy is of considerable interest.

Such metal bands have dimensions which may range from 60 to 30 m in total length, i.e. peripheral extent of the endless band, 0.6 to 3 m in width and 0.6 to 2 mm in thickness.

The products fabricated with the use of such bands often are intended to have optically decorative purposes and thus may have to be perfectly smooth or are required to have patterns which can be formed in them by the texture of the band so that the band may constitute a negative pattern for the contour to be imparted to the surface of the product.

The outer surface of the band, therefore, has a technological function in that it imparts the desired surface qualities to the product, either by structuring the surface of the product or by applying the desired degree of smoothness thereto. The inner surface of the band has only a functional character since it is engaged by the rolls over which the band passes.

The external surface of the band is subject to wear which may alter its structuring and thus the patterns and textures applied to the surface of the workpiece. For that reason it is important to make the outer surface of the band so that it is resistant to wear and, of course, has good anti-adhesion properties with respect to adhesion, resins and bonding agents which may be incorporated in the materials which are pressed. For this purpose, the surface of the band may be provided with one or more galvanically-applied hard chromium layers.

A further requirement for such a band is good shape stability against the thermal and mechanical stresses, specific to the use of the band in the press, which may be applied thereto. Since the energy requirements of the press system require the use of the thinnest possible press bands, the sufficient shape stability which is required, i.e. avoidance of plastic deformation, can usually be achieved only by maintaining the band under high tensions. The band material, therefore, must have a high tensile strength and elastic limit or yield point.

In the past, such bands have been fabricated from cold rolled austenitic chromium-nickel steels of the 17/7 type with a tensile strength of about 1200 N/mm$^2$ or from martensitic chromium nickel steels of the 13/4 type with a tensile strength of about 1000 N/mm$^2$.

The disadvantage of the austenitic types of steels is that the weld seams which are necessary to fashion the strip into an endless band, have a tensile strength of only about 700 N/mm$^2$. The drawback of martensitic types of steel for the purposes described is a relatively low tensile strength which means that the band will not have a satisfactory operating life under the operating conditions prevalent in a double band press or the like.

It is desirable, therefore, to provide for the purposes described, a material with high tensile strength and, indeed, a tensile strength higher than those mentioned above. Attention has been directed in this regard to the precipitation hardenable chromium-nickel steels (i.e. the so-called PH steels), because of the relatively simple thermal treatments which can be carried out with such steels and the good weldability thereof such that even in the regions of the weld seams, tensile strengths up to 1800 N/mm$^2$ can be achieved. Examples of the precipitation hardenable chromium nickel steels which have these characteristics are 15-7 PH, 17-4 PH, 15-5 PH, 17-7 PH, PH 15-7 Mo and PH 13-8 Mo.

The precipitation hardening elements in such steels are generally copper, aluminum, silicon and titanium as alloying components.

In the past, the use of such steels has been contraindicated whenever it was required to provide an electroplated (galvanically deposited) hard chromium layer on the steel.

During the chromium plating process, hydrogen diffusion inside the hardened substrate embrittled the latter so that the possibility of breakage was an important negative factor. This problem was referred to in the literature as hydrogen embrittlement.

OBJECTS OF THE INVENTION

It is, therefore, the principal object of the present invention to provide an improved method of making a band, especially a steel band, for a band press, whereby drawbacks of prior art techniques are avoided.

Another object of the invention is to provide a method of treating a steel band for a double belt press or the like in the pressing of laminates, pressed board and other pressed articles which has a long useful life, an article-contacting surface which manifests reduced wear and a surface to which resins, adhesives and bonding agents from the pressed article are not readily adherent.

Still another object of the invention is to provide an improved steel band, especially for double band presses, in which the hydrogen embrittlement problem does not arise, and which, therefore, has both high tensile strength and long operating life.

SUMMARY OF THE INVENTION

I have discovered, quite surprisingly, that the problems described above can be avoided if one applies to a steel band having a tensile strength of at most 1250 N/mm$^2$ a galvanic coating of hard chromium and utilizes as the substrate material a precipitation hardenable steel so that, after application of the coating, the band can be subjected to a heat treatment of hardening the substrate and bring its tensile strength of a minimum of 1400 N/mm$^2$.

By carrying the precipitation hardening only after the hard chromium coating has been galvanically and chemically applied, surprisingly there is no danger of hydrogen embrittlement even though there may be diffusion of hydrogen in the prior galvanic coating step. This appears to be because the hydrogen diffusion into the substrate is minimized or in any event does not affect the subsequent precipitation hardening.

More particularly the method of making the pressing band for a band press, according to the invention, comprises:

(a) providing a solution-annealed band-shaped precipitation-hardenable steel workpiece having a tensile strength of at most 1250 N/mm$^2$;

(b) galvanically coating at least one surface of the solution-annealed band-shaped precipitation-hardenable steel workpiece with a hard-chromium layer; and (c) thereafter precipitation-hardening the solution-annealed band-shaped precipitation-hardenable steel workpiece with the hard-chromium layer thereon to a tensile strength of at least 1400 N/mm$^2$.

The workpiece can be composed of 15-7 PH, 17-4 PH, 15-5 PH, 17-7 PH, PH 15-7 Mo or PH 13-8 Mo stainless steel.

According to a feature of the invention the workpiece is composed of a composition selected from the group which consists of max. 0.05% by weight carbon
max. 0.10% by weight manganese
max. 0.10% by weight silicon
max. 0.01% by weight phosphorus
max. 0.008% by weight sulfur
12.25 to 13.25% by weight chromium
7.50 to 8.50% by weight nickel
2.00 to 2.50% by weight molybdenum
0.90 to 1.35% by weight aluminum
max. 0.010% by weight nitrogen
balance iron;

max. 0.07% by weight carbon
max. 1.00% by weight manganese
max. 1.00% by weight silicon
max. 0.04% by weight phosphorus
max. 0.030% by weight sulfur
14.00 to 15.50% by weight chromium
3.50 to 5.50% by weight nickel
2.50 to 4.50% by weight copper
0.15 to 0.45% by weight Cb and Ta
balance iron;

max. 0.07% by weight carbon
max. 1.00% by weight manganese
max. 1.00% by weight silicon
max. 0.04% by weight phosphorus
max. 0.030% by weight sulfur
15.50 to 17.50% by weight chromium
3.00 to 5.00% by weight nickel
3.00 to 5.00% by weight copper
0.15 to 0.45% by weight Cb and Ta
balance iron;

max. 0.09% by weight carbon
max. 1.00% by weight manganese
max. 1.00% by weight silicon
max. 0.04% by weight phosphorus
max. 0.040% by weight sulfur
16.00 to 18.00% by weight chromium
6.50 to 7.75% by weight nickel
0.75 to 1.50% by weight aluminum
balance iron; and max. 0.09% by weight carbon
1.0 to 2.0% by weight silicon
max. 1.0% by weight manganese
max. 0.04% by weight phosphorus
max. 0.003% by weight sulfur
6.50 to 7.75% by weight nickel
13.25 to 15.25% by weight chromium
0.4 to 1.0% by weight copper
0.3 to 0.5% by weight titanium
0.5 to 1.0% by weight molybdenum
balance iron.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
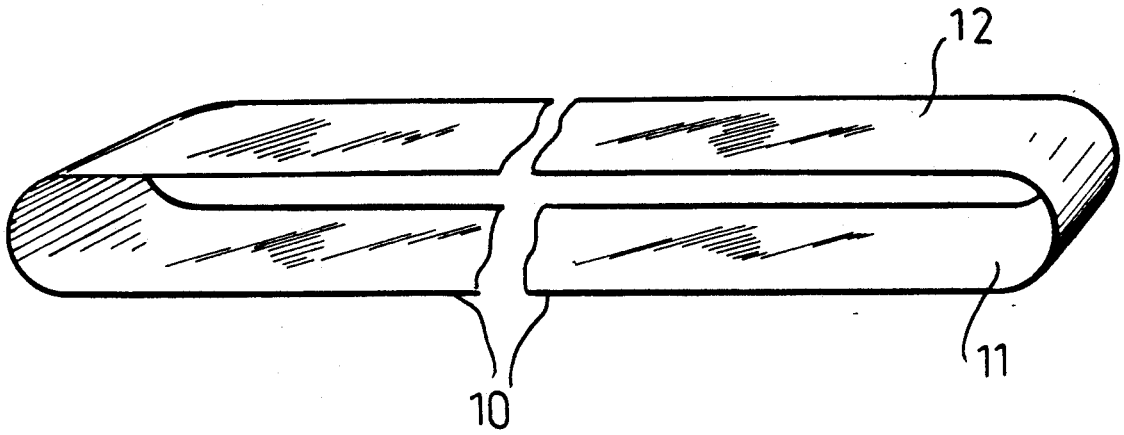
FIG. 1 is a perspective view of a pressing band for a band press according to the invention.
Figure 2:
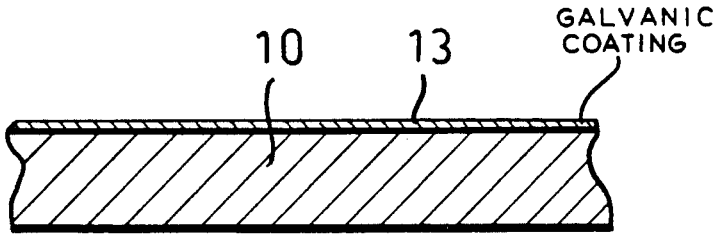
FIG. 2 is a cross sectional view through a pressing band according to the invention.

A band 10 shown in FIG. 1 may have a circumferential length 6 to 30 m, a width of 0.6 to 3 m and a thickness of 0.6 to 2 mm and has an inner surface 11 and an outer surface 12 which may be structured to apply a desired texture or pattern to the pressed article. The outer surface as shown in FIG. 2 is provided with a galvanic coating 13 of hard chromium. This coating may have a thickness of say 0.2 to 0.8 mm.

A band 10 is composed of a precipitation-hardenable steel workpiece of the type described and, after application of the hard chromium coating 13, is subjected to precipitation hardening to bring its tensile strength to a minimum of 1400 N/mm$^2$.

Tests have shown that the bands do not have the afore-described advantageous properties if, prior to the galvanic coating and the precipitation hardening, the tensile strength is greater than 1250 N/mm$^2$. In those cases in which the tensile strength of the workpiece prior to coating and precipitation hardening is in excess of 1250 N/mm$^2$, hydrogen embrittlement is found to be a problem. Hence it is important to the present invention that the workpiece, at least prior to the precipitation-hardening step, have a tensile strength equal to or less than 1250 N/mm$^2$.

The band of the invention thus has a precipitation-hardened substrate with a tensile strength of at least 1400 N/mm$^2$ and higher hardness and at least one side with an adherent galvanically-applied hard chromium coating.

The band under the stresses normally applied in a double-band press has a long useful life and does not show any of the problems associated with hydrogen diffusion heretofore. The band of the invention appears to have such a reduced hydrogen diffusion that the hydrogen diffusion has no detrimental effect on the life and strength of the band.

SPECIFIC EXAMPLE

Example 1

A strip workpiece having a length of 25 m, a width of 2 m and a thickness of 1.5 mm is fabricated by hot or cold rolling from the following composition:

0.04% by weight carbon,
0.09% by weight manganese,
0.05% by weight silicon,
0.005% by weight phosphorus,
0.004% by weight sulfur,
13.0% by weight chromium,
8.0% by weight nickel,
2.25 by weight molybdenum,
1.00% by weight aluminum, max. 0.010% by weight nitrogen,
balance iron,
so that the tensile strength of the strip is less than 1250 $N/mm^2$. The strip is welded to form an endless band and electroplated with a hard chromium layer of a thickness of 0.5 mm. The band is then precipitation hardened under conventional precipitation-hardening conditions until its tensile strength exceeds 1400 $N/mm^2$ (approaching 1600 $N/mm^2$). The band is used with excellent life in a double-band press for the pressing of pressed board and is found to be free from any hydrogen embrittlement.

Example 2

The method of Example 1 is repeated with the following composition of the workpiece:
0.05% by weight carbon,
0.6% by weight manganese,
0.5% by weight silicon,
0.01% by weight phosphorus,
0.01% by weight sulfur,
14.5% by weight chromium,
4.0% by weight nickel,
3.0% by weight copper,
0.15% by weight columbium,
0.15% by weight tantalum,
balance iron.
Substantially the same effective results are obtained.

Example 3

The method of Example 1 was used with the following workpiece composition:
0.06% by weight carbon,
0.7% by weight manganese,
0.4% by weight silicon,
0.02% by weight phosphorus,
0.01% by Weight sulfur,
16.0% by weight chromium,
4.0% by weight nickel,
4.0% by weight copper,
0.2% by weight columbium,
0.2% by weight tantalum,
balance iron.
Again effective results are obtained.

Example 4

The method of Example 1 was carried out with the following strip composition:
0.07% by weight carbon,
0.5% by weight manganese,
0.5% by weight silicon,
0.015% by weight phosphorus,
0.015% by weight sulfur,
17.0% by weight chromium,
1.0% by weight aluminum,
balance iron.
Again the resulting band had a long useful life in a double-band press for the pressing of pressed board without signs of hydrogen embrittlement.

Example 5

An example of a 15-7 PH stainless steel composition which can be used in accordance with the method of Example 1 is:
0.08% by weight carbon,
1.5% by weight silicon,
0.8% by Weight manganese,
0.035% by weight phosphorus,
0.002% by weight sulfur,
7.0% by weight nickel,
15.0% by weight chromium,
0.8% by weight copper,
0.4% by weight titanium,
0.8% by weight molybdenum,
balance iron.

I claim:

1. A method of making a pressing bank for a band press, comprising in consecutive order the steps of:

(a) providing a solution-annealed band-shaped precipitation-hardenable steel workpiece having a tensile strength of at most 1250 $N/mm^2$;

(b) galvanically coating at least one surface of said solution-annealed band-shaped precipitation-hardenable steel workpiece with a hard-chromium layer; and (c) thereafter precipitation-hardening said solution-annealed band-shaped precipitation-hardenable steel workpiece with said hard-chromium layer thereon to a tensile strength of at least 1400 $N/mm^2$.

2. The method defined in claim 1 wherein said workpiece is composed of 15-7 PH, 17-4 PH, 15-5 PH, 17-7 PH, PH 15-7 Mo or PH 13-8 Mo stainless steel.

3. The method defined in claim 1 wherein said workpiece is composed of a composition selected from the group which consists of:

max. 0.5% by weight carbon
max. 0.10% by weight manganese
max 0.10% by weight silicon
max. 0.01% by weight phosphorus
max. 0.008% by weight sulfur
12.25 to 13.25% by weight chromium
7.50 to 8.50% by weight nickel
2.00 to 2.50% by weight molybdenum
0.90 to 1.35% by weight aluminum
max. 0.010% by weight nitrogen
balance iron;

max. 0.07% by weight carbon
max. 1.00% by weight manganese
max. 1.00% by weight silicon
max. 0.04% by weight phosphorus
max. 0.030% by weight sulfur
14.00 to 15.50% by weight chromium
3.50 to 5.50% by weight nickel
2.50 to 4.50% by weight copper
0.15 to 0.45% by weight Cb and Ta
balance iron;

max. 0.07% by weight carbon
max. 1.00% by weight manganese
max. 1.00% by weight silicon
max. 0.04% by weight phosphorus
max. 0.030% by weight sulfur
15.50 to 17.50% by weight chromium
3.00 to 5.00% by weight nickel
3.00 to 5.00% by weight copper
0.15 to 0.45% by weight Cb and Ta
balance iron;

max. 0.09% by weight carbon
max. 1.00% by weight manganese
max. 1.00% by weight silicon
max. 0.04% by weight phosphorus
max. 0.040% by weight sulfur
16.00 to 18.00% by weight chromium
6.50 to 7.75% by weight nickel
0.75 to 1.50% by weight aluminum
balance iron; and max. 0.09% by weight carbon
1.0 to 2.0% by weight silicon
max. 1.0% by weight manganese
max. 0.04% by weight phosphorus
max. 0.003% by weight sulfur
6.50 to 7.75% by weight nickel
13.25 to 15.25% by weight chromium
0.4 to 1.0% by weight copper
0.3 to 0.5% by weight titanium
0.5 to 1.0% by weight molybdenum
balance iron.

* * * * *